US010151059B1

(12) United States Patent
Tsai

(10) Patent No.: US 10,151,059 B1
(45) Date of Patent: Dec. 11, 2018

(54) CLOTHES DRYER

(71) Applicant: KE M.O. HOUSE CO., LTD., Shenzhen (CN)

(72) Inventor: Mo-Tsan Tsai, Shenzhen (CN)

(73) Assignee: KE M.O. HOUSE CO., LTD., Shenzhen (CN)

( * ) Notice: Subject to any disclaimer, the term of this patent is extended or adjusted under 35 U.S.C. 154(b) by 0 days.

(21) Appl. No.: 15/651,124

(22) Filed: Jul. 17, 2017

(30) Foreign Application Priority Data

Jun. 9, 2017 (CN) ..... 2017 2 0671847 U

(51) Int. Cl.

| | |
|---|---|
| ***D06F 57/08*** | (2006.01) |
| ***A47G 25/06*** | (2006.01) |
| ***D06F 58/10*** | (2006.01) |
| *A47F 5/00* | (2006.01) |
| *D06F 57/00* | (2006.01) |
| *D06F 58/00* | (2006.01) |

(52) U.S. Cl.
CPC ..... *D06F 57/08* (2013.01); *A47G 25/0664* (2013.01); *D06F 58/10* (2013.01); *A47F 5/00* (2013.01); *D06F 57/00* (2013.01); *D06F 58/00* (2013.01)

(58) Field of Classification Search
CPC ..... D06F 57/08; D06F 58/10; D06F 57/00; D06F 58/00; A47G 5/00; A47G 25/0664
USPC ..... 34/595
See application file for complete search history.

(56) References Cited

U.S. PATENT DOCUMENTS 1,680,524 A * 8/1928 Killmnick ..... D06F 3/00 34/106
1,833,631 A * 11/1931 Wilsey ..... D06F 58/14 211/180
2,241,702 A * 5/1941 Glover, Jr. ..... D06F 73/00 223/70
3,048,310 A * 8/1962 Dosal ..... D06F 73/00 223/70
3,197,886 A * 8/1965 Brame ..... D06F 58/00 251/149.2
3,432,939 A * 3/1969 Eichholz ..... D06F 58/14 223/51
4,682,424 A * 7/1987 Irving ..... D06F 58/10 211/123

(Continued)

FOREIGN PATENT DOCUMENTS

EP 2009171 A1 * 12/2008 ..... D06F 58/10
GB 2407860 A * 5/2005 ..... D06F 58/10

(Continued)

*Primary Examiner* — Stephen M Gravini
(74) *Attorney, Agent, or Firm* — Hauptman Ham, LLP

(57) ABSTRACT

Provided is a clothes drier including a drying device, a base, a support rod, and a drying jacket. The base is provided with an air inlet and an air outlet. The drying device is disposed inside the base. The support rod has a first end disposed on the base and a second end extending in a direction away from the base. The support rod can be a telescopic rod. The drying jacket is suspended from the second end of the support rod and further arranged to enclose the base. The drying jacket is used for being sheathed in clothes. According to the clothes drier the drying device is disposed inside the base and the telescopic support rod is fixedly disposed on the base so as to facilitate the drying of the clothes hung on the support rod by the drying device.

20 Claims, 3 Drawing Sheets

(56) References Cited

U.S. PATENT DOCUMENTS 5,555,640 A * 9/1996 Ou ..... A47L 19/00 211/133.6
5,555,648 A * 9/1996 Griffin ..... D06F 59/02 23/67
5,592,750 A * 1/1997 Eichten ..... D06F 59/02 223/70
5,755,040 A * 5/1998 Ou ..... A47L 23/205 34/202
6,047,482 A * 4/2000 Roper ..... D06F 58/00 34/106
6,185,834 B1 * 2/2001 Yang ..... D06F 57/00 34/236
6,457,257 B1 * 10/2002 Hughes ..... F26B 9/003 34/218
7,121,017 B2 * 10/2006 DuRapau ..... A47L 23/205 34/381
7,430,816 B1 * 10/2008 Lozenski ..... A47L 23/205 34/104
7,941,936 B2 * 5/2011 Mangano ..... D06F 58/14 206/287
8,307,567 B2 * 11/2012 Han ..... D06F 31/00 34/132
8,327,558 B2 * 12/2012 Hu ..... D06F 58/14 34/210
8,407,914 B2 * 4/2013 Hollinger ..... D06F 58/10 223/85
8,695,228 B2 * 4/2014 Lee ..... D06F 73/02 34/595
8,789,729 B2 * 7/2014 Beckett ..... D06F 59/02 223/120
8,955,234 B2 * 2/2015 Williams ..... F26B 23/04 211/85.7
8,966,781 B1 * 3/2015 McKernan ..... A61L 2/07 211/189
8,984,766 B2 * 3/2015 Williams ..... F26B 20/00 34/381
9,140,497 B2 * 9/2015 Al-Shahrani ..... F26B 9/10
9,828,715 B2 * 11/2017 Kwon ..... D06F 25/00
2006/0042114 A1 * 3/2006 Robson ..... D06F 59/02 34/90
2006/0054576 A1 * 3/2006 Durham ..... A47L 23/205 211/85.7
2008/0222909 A1 * 9/2008 Picozza ..... D06F 58/14 34/195
2015/0337482 A1 * 11/2015 Silagy ..... D06F 5/04 34/103

FOREIGN PATENT DOCUMENTS

JP 10192596 A * 7/1998
KR 101475231 B1 * 12/2014 ..... D06F 58/10
WO WO 9629458 A1 * 9/1996 ..... A61L 2/07

* cited by examiner

CLOTHES DRYER

CROSS REFERENCE TO RELATED APPLICATIONS

This application claims priority to Chinese Application No. 201720671847.1, filed on Jun. 9, 2017, the disclosure of which is incorporated by reference herein.

TECHNICAL FIELD

This disclosure generally relates to household appliances, and more particularly relates to a clothes drier.

BACKGROUND

A clothes drier is used for drying clothes. It eliminates the need of prolonged air drying or sun drying and thus brings convenience to life.

A currently available clothes drier typically includes a cabinet and a heater. Clothes can be placed in the cabinet and thus be dried through the hot air produced by the heater. Such clothes driers, however, usually have a large volume, and therefore are not convenient for placement and storage.

SUMMARY

Embodiments disclosed herein provide a clothes drier which is convenient for storage and which can also provide drying and ironing.

There is provided a clothes drier including a drying device, a base, and a support rod. The base may be provided with an air inlet and an air outlet. The drying device may be disposed inside the base and used to draw and heat the air from the air inlet of the base and further blow the heated air out of the air outlet of the base. The support rod may have a first end disposed on the base and a second end extending in a direction away from the base. The second end may be used to suspend clothes.

The support rod may be a telescopic rod.

The clothes drier may further include a drying jacket suspended from the second end of the support rod and further sleeved at the base. The drying jacket may be configured to be sheathed in clothes.

The drying jacket may include: a main body suspended from the second end of the support rod and sleeved at the base; and two sleeves provided on both sides of the main body respectively. Both the main body and the two sleeves may be defined with through holes.

The clothes drier may further include a support frame which is disposed on the second end of the support rod and which is used for supporting clothes.

The support frame may include: a fixed portion fixedly disposed on the second end of the support rod; and two support arms disposed on both sides of the fixed portion respectively. The two support arms may be configured for holding up clothes.

The support arms may be arcuate in shape. One end of each support arm may be disposed on the fixed portion, while the other end thereof may be gently curved away from the fixed portion and close to the base.

The air outlet may be disposed adjacent to the support rod.

A top surface of the base may have an edge protruding out from sides of the base.

The drying device may include a heater, an air sucker, and an air blower. The air sucker may be arranged close to the air inlet of the base. The air blower may be disposed close to the air outlet of the base. The heater may be located between the air sucker and the air blower so that the heater can heat up the air drawn by the air sucker through the air inlet and further the heated air can be blown out of the air outlet by the air blower.

According to the clothes drier provided by the disclosure, the drying device is disposed inside the base and the support rod used for hanging clothes is fixedly disposed on the base so as to facilitate the drying of the clothes hung on the support rod by the drying devices inside the base. Furthermore, when the clothes drier needs to be disassembled, the support rod need only be removed from the base, making the clothes drier easy for storage.

In addition, in some embodiments, a drying jacket may further be provided on the clothes drier whereby clothes can be set to sheathe the drying jacket and thus be expanded by the drying jacket. As a result, clothes can be dried while achieving ironing effects at the same time.

BRIEF DESCRIPTION OF THE ACCOMPANYING DRAWINGS

To better illustrate the technical solutions of the disclosure, a brief description of the accompanying drawings for use in relation to the illustration of the embodiments is provided below. It would be obvious that the drawings described below depict merely some embodiments of the disclosure and those of ordinary skill in the art can obtain other drawings based on the arrangements shown in these drawings without making creative efforts.

DETAILED DESCRIPTION OF ILLUSTRATED EMBODIMENTS

Hereinbelow technical solutions of embodiments of the disclosure will be described in definite and comprehensive detail with reference made to the accompanying drawings.

Figure 1:
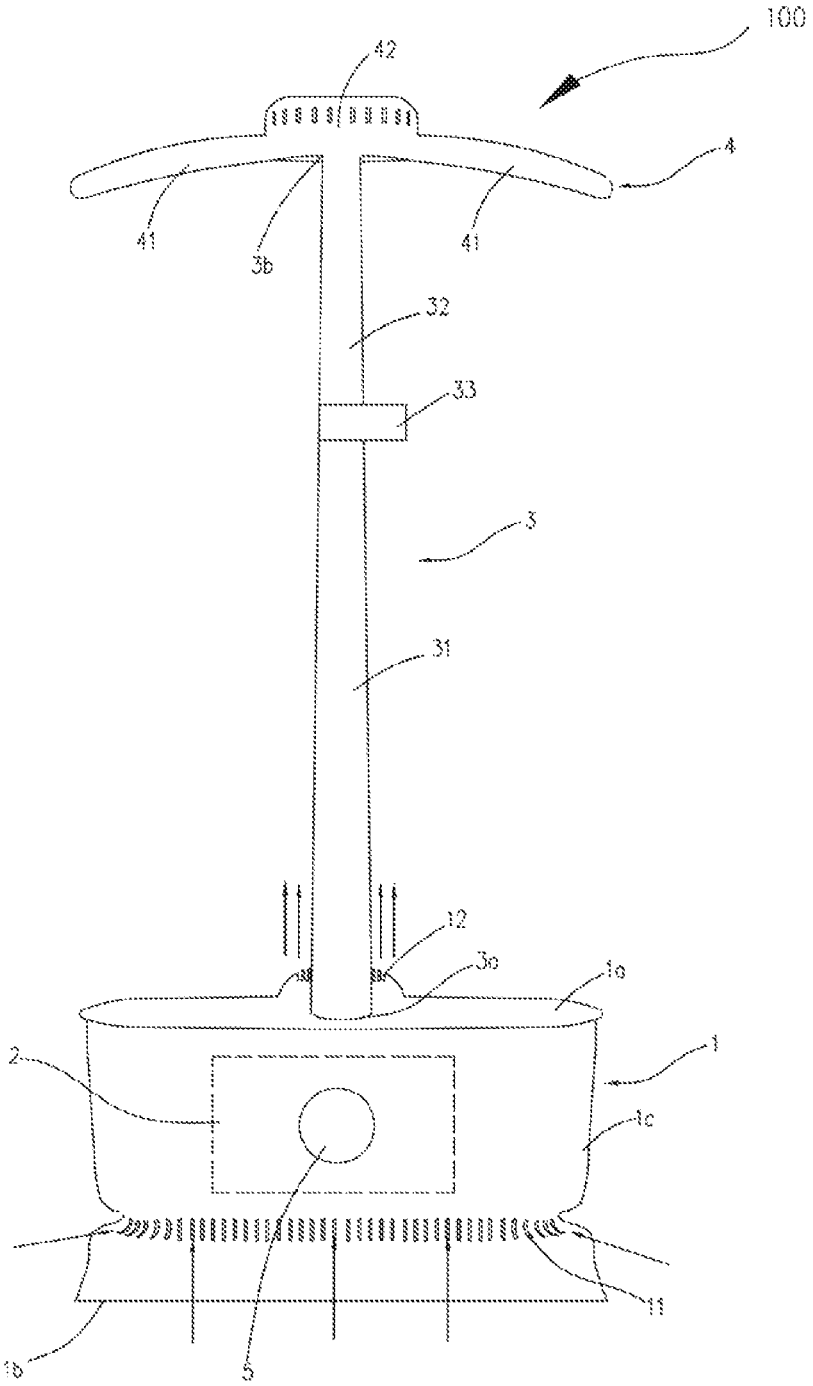
FIG. 1 is a schematic diagram illustrating a clothes drier according to an embodiment of the disclosure.

FIG. 1 shows a clothes drier 100 provided by an embodiment of the disclosure. Clothes drier 100 may include a base 1, a drying device 2, and a support rod 3. Base 1 may be provided with an air inlet 11 and an air outlet 12. Drying device 2 may be disposed inside base 1 and may be used to draw and heat the air from air inlet 11 of base 1 and further blow the heated air out of air outlet 12 of base 1. Support rod 3 may have a first end 3*a* disposed on base 1 and a second end 3*b* extending in a direction away from base 1. The second end 3*b* may be used to hang clothes.

According to this embodiment, drying device 2 is disposed inside base 1 and support rod 3 used for suspending clothes is fixedly disposed on base 1 so as to facilitate the drying of clothes hung on support rod 3 by drying device 2. Furthermore, when clothes drier 100 needs to be disassembled, the support rod 3 need only be removed from base 1, making clothes drier 100 easy for storage.

In this embodiment, a horizontal cross-section of base 1 may be of an elongated oval shape. Base 1 may include a top surface 1*a* and a bottom surface 1*b* running opposite to each other, and a side surface 1*c* connected between top surface 1*a* and bottom surface 1*b*. Herein, the direction pointing from bottom surface 1*b* to top surface 1*a* is defined as "upward" for illustration purposes only.

In order that the hot air produced by drying device 2 can be blown to the utmost toward clothes for the purpose of rapidly drying clothes, air outlet 12 may be opened in the middle of top surface 1*a* so that the hot air produced by drying device 2 can be blown upwards after passing through air outlet 12 thus rapidly drying clothes. In other embodiments, however, air outlet 12 can also be defined on side surface 1*c* of base 1.

Air inlet 11 may be disposed on the encircling side surface 1*c* and close to bottom surface 1*b* of base 1. Disposed in side surface 1*c*, air inlet 11 would be capable of sucking as much air surrounding base 1 as possible into base 1. In other embodiments, however, air inlet 11 can also be provided adjacent to top surface 1*a*.

In this embodiment, drying device 2 may include a heater, an air sucker, and an air blower. The air sucker may be arranged close to air inlet 11 of base 1. The air blower may be disposed close to air outlet 12 of base 1. The heater may be installed between the air sucker and the air blower so that the heater can heat up the air drawn by the air sucker through air inlet 11 of base 1 and further the heated air can be blown out of air outlet 12 by the air blower. Specifically, the air sucker in base 1 may draw the outside air into the inside of base 1 through air inlet 11 of base 1. Then the drawn air may be heated up by the heater and the heated air would finally be blown to the outside through air outlet 12 of base 1.

In the present embodiment, first end 3*a* of support rod 3 may be detachably connected to the center of top surface 1*a* on base 1. As such, support rod 3 may be adjacent to air outlet 12. When wind is blown out of air outlet 12, it can be quickly blown to support rod 3 so that clothes hung on support rod 3 can be dried as soon as possible.

When dying clothes, clothes may be hung on second end 3*b* of support rod 3 and let naturally fall, where when dying relatively long clothes, the lower part of the clothes can be sleeved on base 1. Then drying device 2 may be started to operate and so the air sucker in base 1 may draw the ambient air into the inside of base 1 through air inlet 11 of base 1. The drawn air afterwards may be heated up by the heater and the heated air would be blown out of air outlet 12 of base 1. When dying the comparatively long clothes as mentioned above, its lower part would be sleeved on base 1, therefore air outlet 12 would be situated inside the space enclosed by clothes and so the hot air blown out of drier 100 can rapidly dry clothes from its inside.

Furthermore, support rod 3 may be a telescopic rod. Relying on the telescopic structure of support rod 3, it would be convenient to adjust its length, thus facilitating the quick drying of clothes by clothes drier 100 and so improving the ease of storage of clothes drier 100.

In particular, support rod 3 may include a fixed bar 31, a slide bar 32, and a fastening member 33. One end of fixed bar 31, i.e., the first end 3*a* of support rod 3, may be fixed to base 1, while the other end of fixed bar 31 may be sleeved on slide bar 32. Fastening member 33 may be provided at the connection of fixed bar 31 and slide bar 32. When slide bar 32 is slid a certain length relative to fixed bar 31, the fastening member 33 can be used to lock the two together whereby support rod 3 can be fixed at the required length. Fastening member 33 may be a hoop.

When dying relatively long clothes, it can be suspended from the free end of slide bar 32 and the height of support rod 3 can be adjusted in order that clothes can be sleeved on base 1, thereby clothes drier 100 would be able to dry clothes from its inside which improves the drying efficiency. When relatively short clothes is dried, it can be hung at the free end of slide bar 32 and the height of support rod 3 can be adjusted in order that clothes can be brought as close to air outlet 12 as possible, so as to facilitate the drying of clothes by clothes drier 100 and thus improve the drying efficiency.

When clothes drier 100 is not to be used for a long period of time, support rod 3 can be arranged into its minimum length and can then be removed from base 1. The telescopic structure of support rod 3 and its detachable structure in relation to base 1 may further improve the ease of storage of clothes drier 100.

In addition, clothes drier 100 may further include a support frame 4 disposed at second end 3*b* of support rod 3 which may be configured to hold up clothes. By the provided support frame 4 clothes can be hung in a better way on clothes drier 100 and so the shape of clothes can be maintained, which improves the reliability of clothes drier 100.

Figure 2:
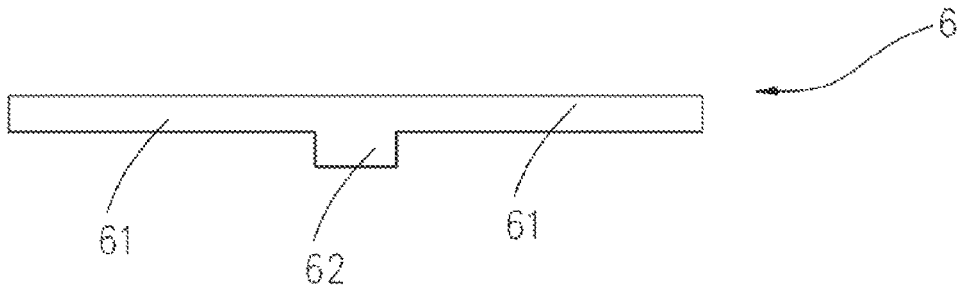
FIG. 2 is a diagram illustrating a support frame according to an embodiment of the disclosure.
Figure 3:
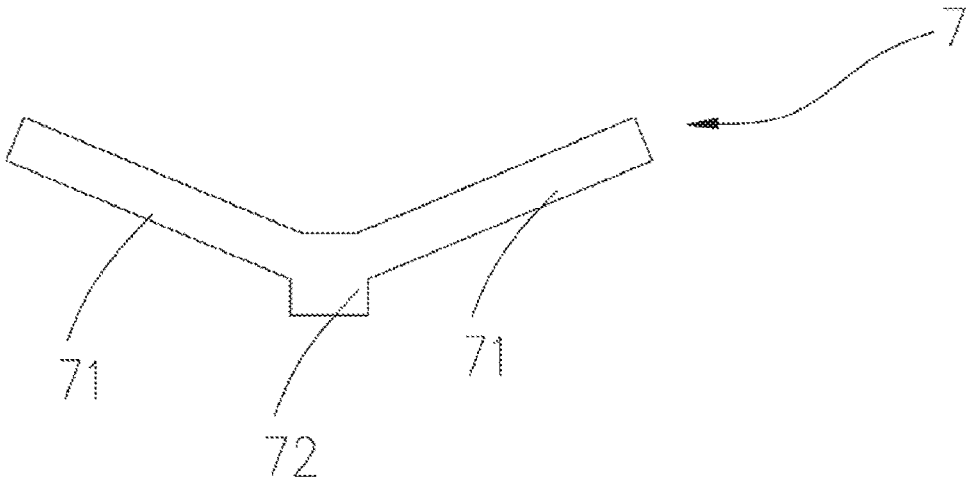
FIG. 3 is a diagram illustrating another support frame according to an embodiment of the disclosure.
Figure 4:
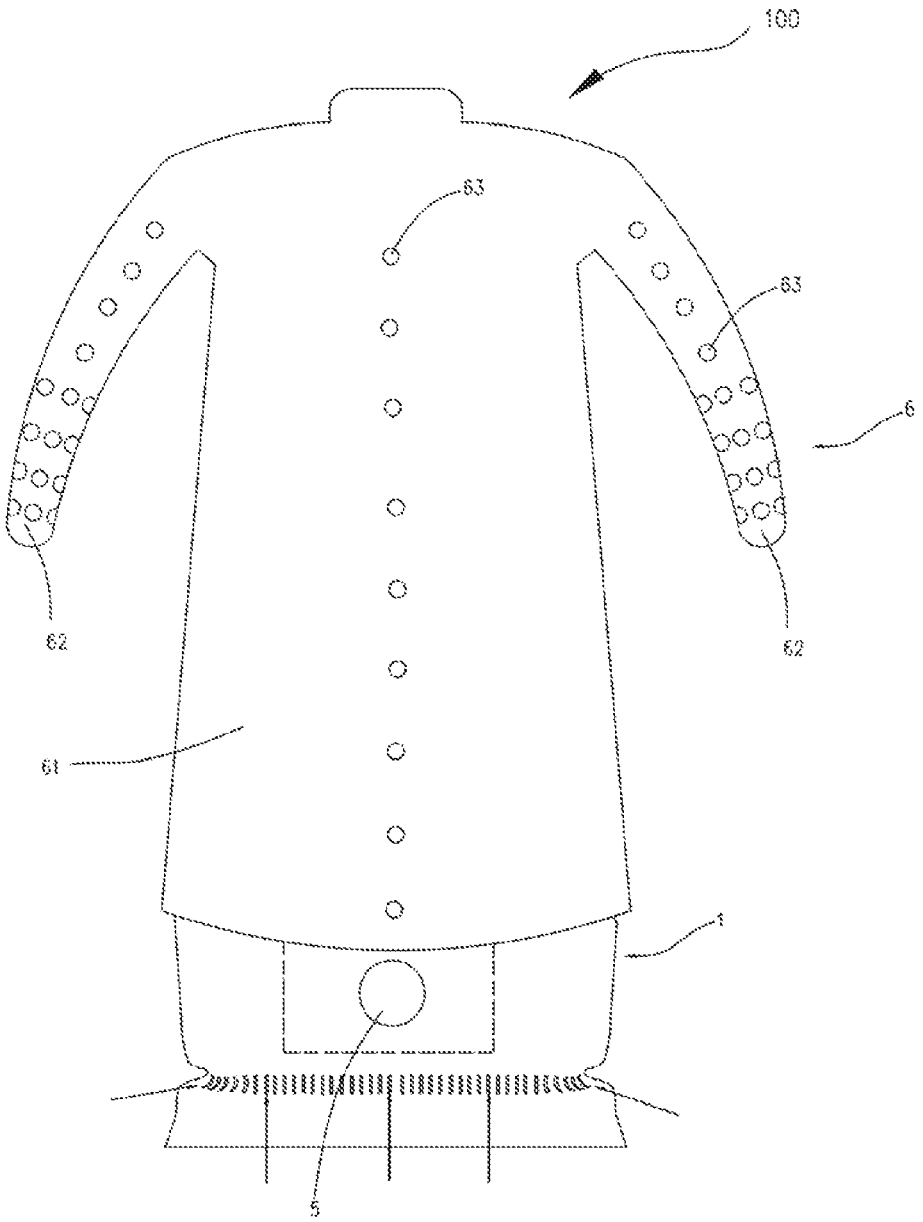
FIG. 4 is a schematic diagram illustrating a clothes drier including a drying jacket according to an embodiment of the disclosure.

Support frame 4 may include: a fixed portion 42 fixedly disposed on second end 3*b* of support rod 3; and two support arms 41 provided on both sides of fixed portion 42 respectively. The two support arms 41 may be configured to hold up clothes. Specifically, support arms 41 may be arcuate in shape. One end of each support arm 41 may be disposed on fixed portion 42, while the other end thereof may be gently curved away from fixed portion 42 and close to base 1. The arc-shaped support arms 41 can be similar in shape to the shoulders of clothes, thus the shape of clothes being dried on clothes drier 100 can further be maintained, which further improves the reliability of clothes drier 100. In other embodiments, for example, with reference made to FIG. 2, support frame 6 may be slotted in shape, where each support arm 61 may be of a flat plate shape. Alternatively, as illustrated in FIG. 3, support frame 7 may be of a Y shape, where two support arms 71 extend away from fixed portion 72.

Fixed portion 42 may be provided with a through hole cooperating with second end 3*b* of support rod 3 whereby support frame 4 can be fixed to support rod 3. Such an engagement also can allow support frame 4 to be readily removed from support rod 3, thus facilitating the storage of clothes drier 100.

Furthermore, the edge of top surface 1*a* of base 1 may protrude out from side surface 1*c* of base 1.

Specifically, the edge of top surface 1*a* of base 1 may be raised so as to protrude out from side surface 1*c* of base 1. By protruding the edge of top surface 1*a* of base 1 from the sides of base 1, clothes can be better fitted to base 1.

Clothes drier 100 may further include a knob 5 disposed on side surface 1*c* of base 1 and coupled to drying device 2 which is used to control the working duration of clothes drier 100. In particular, the drying duration of clothes drier 100 can be set through rotating knob 5.

Furthermore, clothes drier 100 may further include a drying jacket 6 suspended from second end 3*b* of support rod 3 and further sleeved on base 1. Drying jacket 6 may be configured to be sheathed in clothes.

By providing drying jacket 6 on clothes drier 100, clothes can be fitted against drying jacket 6 and so be expanded by drying jacket 6. Clothes can be dried while achieving ironing effects at the same time.

In particular, drying jacket 6 may include: a main body 61 suspended from second end 3*b* of support rod 3 and arranged to enclose base 1; and two sleeves 62 provided on both sides of main body 61 respectively. Both main body 61 and the two sleeves 62 may be provided with multiple through holes 63. Drying jacket 6 may be of a long-sleeved jacket style and may be made of a waterproof material. Main body 61 can be a complete sheath. The collar part of main body 61 may be directly attached to support frame 4, while the two sleeves 62 may extend along support arms 41. When knob 5 is rotated for drying, drying jacket 6 may be inflated with hot air and thus be expanded, so it would be able to hold up clothes set thereon thus making clothes free of wrinkles, i.e., achieving the ironing effects. Through holes 63 can be provided running down the middle of main body 61. The two sleeves 62 also may be provided with through holes 63. The aforementioned through holes 63 can allow the hot air produced by base 1 to be blown through drying jacket 6 to clothes thus speeding up the drying of clothes.

When dying clothes, drying jacket 6 can be suspended from the free end of slide bar 32 and the height of support rod 3 can be adjusted in order that drying jacket 6 can be fitted around the edge of top surface 1*a* of base 1. Then clothes can be set on drying jacket 6 and the drying duration of clothes drier 100 can be set through rotating knob 5. As such, clothes drier 100 can dry and iron clothes in a better manner and so the drying efficiency can be improved.

When clothes drier 100 is not to be used for a long period of time, support rod 3 can be arranged into its minimum length and can then be removed from drying jacket 6. The telescopic structure of support rod 3 and its detachable structure in relation to base 1 can further improve the ease of storage of clothes drier 100.

According to the clothes drier 100 provided by the disclosure, drying device 2 is disposed inside base 1 and the support rod 3 used for suspending clothes is fixedly disposed on base 1 so as to facilitate the drying of the clothes hung on support rod 3 by drying device 2 inside base 1. Furthermore, when clothes drier 100 needs to be disassembled, support rod 3 need only be removed from base 1, making the clothes drier 100 easy for storage.

The foregoing description merely depicts some exemplary embodiments of the disclosure and it will be apparent to those skilled in the art that a number of improvements and modifications may be made without departing from the principles of the disclosure. All such improvements and modifications shall be considered as falling in the scope of protection of the disclosure.

What is claimed is:

1. A clothes drier comprising a drying device, a base, and a support rod, wherein the base is provided with an air inlet and an air outlet, the drying device is disposed inside the base and is configured to draw and heat air from the air inlet of the base and further blow heated air out of the air outlet of the base; the support rod comprises a first end disposed on the base and a second end extending in a direction away from the base, the second end being configured to hang clothes; the support rod is a telescopic rod and configured to pass through a garment; wherein the first end of the support rod, the garment and an edge of a top surface of the base is configured to define a drying space to receive the heated air out of the base.

2. A clothes drier comprising a drying device, a base, and a support rod, wherein the base is provided with an air inlet and an air outlet, the drying device is disposed inside the base and is configured to draw and heat air from the air inlet of the base and further blow heated air out of the air outlet of the base; the support rod comprises a first end disposed on the base and a second end extending in a direction away from the base, the second end being configured to hang clothes, wherein the clothes drier further comprises a drying jacket suspended from the second end of the support rod and further sleeved on the base, the drying jacket being configured to be sheathed in clothes.

3. The clothes drier according to claim 2, wherein the drying jacket comprises: a main body suspended from the second end of the support rod and sleeved on the base; and two sleeves provided on both sides of the main body respectively, wherein both the main body and the two sleeves are provided with through holes.

4. The clothes drier according to claim 1, further comprising a support frame disposed on the second end of the support rod and configured for holding up clothes.

5. The clothes drier according to claim 4, wherein the support frame comprises: a fixed portion fixedly disposed on the second end of the support rod; and two support arms provided on both sides of the fixed portion respectively and configured for holding up clothes.

6. The clothes drier according to claim 5, wherein the support arms are arcuate in shape, one end of each support arm being disposed on the fixed portion while another end thereof being gently curved away from the fixed portion and close to the base.

7. The clothes drier according to claim 1, wherein the air outlet is disposed adjacent to the support rod.

8. The clothes drier according to claim 1, wherein the edge of the top surface of the base is protruding out from sides of the base.

9. The clothes drier according to claim 1, wherein the drying device comprises a heater, an air sucker, and an air blower, wherein the air sucker is arranged close to the air inlet of the base, the air blower is arranged close to the air outlet of the base, and the heater is installed between the air sucker and the air blower and is configured to heat up the air drawn by the air sucker through the air inlet of the base and so that the heated air is blown out of the air outlet by the air blower.

10. The clothes drier according to claim 1, wherein the air outlet is disposed adjacent to the support rod.

11. The clothes drier according to claim 2, wherein the air outlet is disposed adjacent to the support rod.

12. The clothes drier according to claim 3, wherein the air outlet is disposed adjacent to the support rod.

13. The clothes drier according to claim 4, wherein the air outlet is disposed adjacent to the support rod.

14. The clothes drier according to claim 5, wherein the air outlet is disposed adjacent to the support rod.

15. The clothes drier according to claim 1, wherein the edge of the top surface of the base is protruding out from sides of the base.

16. The clothes drier according to claim 2, wherein the edge of the top surface of the base is protruding out from sides of the base.

17. The clothes drier according to claim 3, wherein the edge of the top surface of the base is protruding out from sides of the base.

18. The clothes drier according to claim 4, wherein the edge of the top surface of the base is protruding out from sides of the base.

19. The clothes drier according to claim 5, wherein the edge of the top surface of the base is protruding out from sides of the base.

20. A clothes drier, comprising:

a drying device;

a base; and a support rod, wherein the base is provided with an air inlet and an air outlet, and the drying device is disposed inside the base and is configured to draw and heat air from the air inlet of the base and further blow heated air out of the air outlet of the base, the support rod comprises a first end disposed on the base and a second end extending in a direction away from the base, the second end being configured to hang clothes, the support rod is a telescopic rod and configured to pass through a garment, and an end of the garment is configured to hang on the first end of the support rod, another end of the garment is configured to opposite to the air inlet of the base, and the garment is configured to receive the heated air out of the base.

* * * * *